US007334991B2

(12) United States Patent
Liang

(10) Patent No.: US 7,334,991 B2
(45) Date of Patent: Feb. 26, 2008

(54) TURBINE BLADE TIP COOLING SYSTEM

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 125 days.

(21) Appl. No.: 11/031,795

(22) Filed: Jan. 7, 2005

(65) Prior Publication Data

US 2006/0153680 A1 Jul. 13, 2006

(51) Int. Cl.
*F01D 5/18* (2006.01)

(52) U.S. Cl. ..... 416/97 R

(58) Field of Classification Search ..... 415/115; 416/97 R, 96 R

See application file for complete search history.

(56) References Cited

U.S. PATENT DOCUMENTS

| | | | | |
|---|---|---|---|---|
| 3,816,022 | A | 6/1974 | Day | |
| 3,854,842 | A | 12/1974 | Caudill | |
| 4,111,604 | A | 9/1978 | Kydd | |
| 4,130,373 | A | 12/1978 | Giles | |
| 4,350,473 | A | 9/1982 | Dakin | |
| 4,753,575 | A | 6/1988 | Levengood et al. | |
| 4,767,268 | A | 8/1988 | Auxier et al. | |
| 5,667,359 | A | 9/1997 | Huber et al. | |
| 5,720,431 | A | 2/1998 | Sellers et al. | |
| 5,864,949 | A * | 2/1999 | Kildea | 29/889.7 |
| 6,174,133 | B1 | 1/2001 | Bunker | |
| 6,705,836 | B2 | 3/2004 | Bourriaud et al. | |
| 6,932,571 | B2 * | 8/2005 | Cunha et al. | 416/97 R |
| 2002/0106275 | A1 | 8/2002 | Harvey | |
| 2003/0021684 | A1 | 1/2003 | Downs et al. | |
| 2004/0179940 | A1 | 9/2004 | Liang | |

* cited by examiner

*Primary Examiner*—Edward K. Look
*Assistant Examiner*—Nathan Wiehe

(57) ABSTRACT

A turbine blade for a turbine engine having a cooling system in the turbine blade formed from at least one elongated tip cooling chamber for passing cooling fluids in close proximity to an outer surface of the tip section of a turbine blade. The cooling system may include one or more elongated tip cooling chambers positioned in the tip section of a turbine blade for receiving cooling fluids through metering slots for regulating the flow and for exhausting those fluids from the turbine blade through the pressure sidewall to be used in external film cooling applications. The elongated tip cooling chambers enable the outer wall forming the tip section to be cooled internally and externally with cooling fluids.

10 Claims, 3 Drawing Sheets

TURBINE BLADE TIP COOLING SYSTEM

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Often times, localized hot spots form in the tip section of turbine blades. Thus, a need exists for removing excessive heat in the tip section of turbine blades.

SUMMARY OF THE INVENTION

This invention relates to a turbine blade cooling system formed from at least one cavity extending through an elongated blade and one or more elongated tip cooling chambers in communication with the cavity. The elongated tip cooling chamber forms a portion of the cooling system and is positioned in the tip section proximate to an outer end of the tip section. The outer tip section may or may not include an abrasive treatment layer on the tip section. In at least one embodiment, the elongated tip cooling chamber extends generally orthogonal to a longitudinal axis of the turbine blade. During use, the elongated tip cooling chamber enables the outer wall forming a portion of the tip section to be cooled internally and externally.

The elongated tip cooling chamber may include openings through the pressure sidewall for exhausting cooling fluids from the cooling system in the turbine blade. The openings may, in at least one embodiment, be slots formed by ribs that extend within the elongated tip cooling chamber from proximate the pressure sidewall toward the suction sidewall. The slots may be sized so that cooling fluids exhausted from the cooling system do not disrupt the film layer of cooling fluids proximate to an outer surface of the turbine blade. Rather, the slots are sized to exhaust cooling fluids from the cooling system such that the cooling fluids may combine with the film cooling fluids on the outer surfaces of the pressure sidewall and the end of the tip section.

The cooling system may also include one or more cooling fluid orifices providing a cooling fluid pathway between the cavity and the elongated tip cooling chamber. In at least one embodiment, the cooling fluid orifices may be metering slots for controlling the flow of cooling fluids into the elongated tip cooling chambers. Each elongated tip cooling chamber may include one or a plurality of metering slots through which supplying cooling fluids may flow.

An advantage of this invention is that the configuration of the cooling system increases the efficiency of the cooling system in the tip of a turbine blade by cooling both the internal and external portions of the outer wall forming a portion of the tip.

Another advantage of this invention is that the cooling system design is easily repaired should the abrasive treatment layer on the tip section of the turbine blade be damaged by removing the abrasive treatment layer on the tip section and replacing it with an undamaged abrasive tip treatment layer. Replacing the abrasive tip treatment layer does not create the risk of filling orifices or other cooling system fluid pathways that is typical in conventional designs.

Yet another advantage of this invention is that the cooling fluid orifices that connect the elongated tip cooling chambers with the remainder of the cooling system can also operate as core printout holes during manufacturing, and thus, eliminate the need to fill core printout holes as is typical in conventional turbine blades.

Still another advantage of this invention is that the cooling fluid flow into the elongated tip cooling chambers may be controlled through the size of the cooling fluid orifices, which are also referred to as metering slots, thereby enhancing the efficiency of the cooling system. In fact, the flow of cooling fluids may be determined for each elongated tip cooling chamber between the leading and trailing edges of the turbine blade.

Another advantage of this invention is that the elongated tip cooling chambers and openings in the pressure sidewall may be formed in the turbine blade during the casting process of making the turbine blade, thereby eliminating the need to drill exhaust orifices in the turbine blade.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
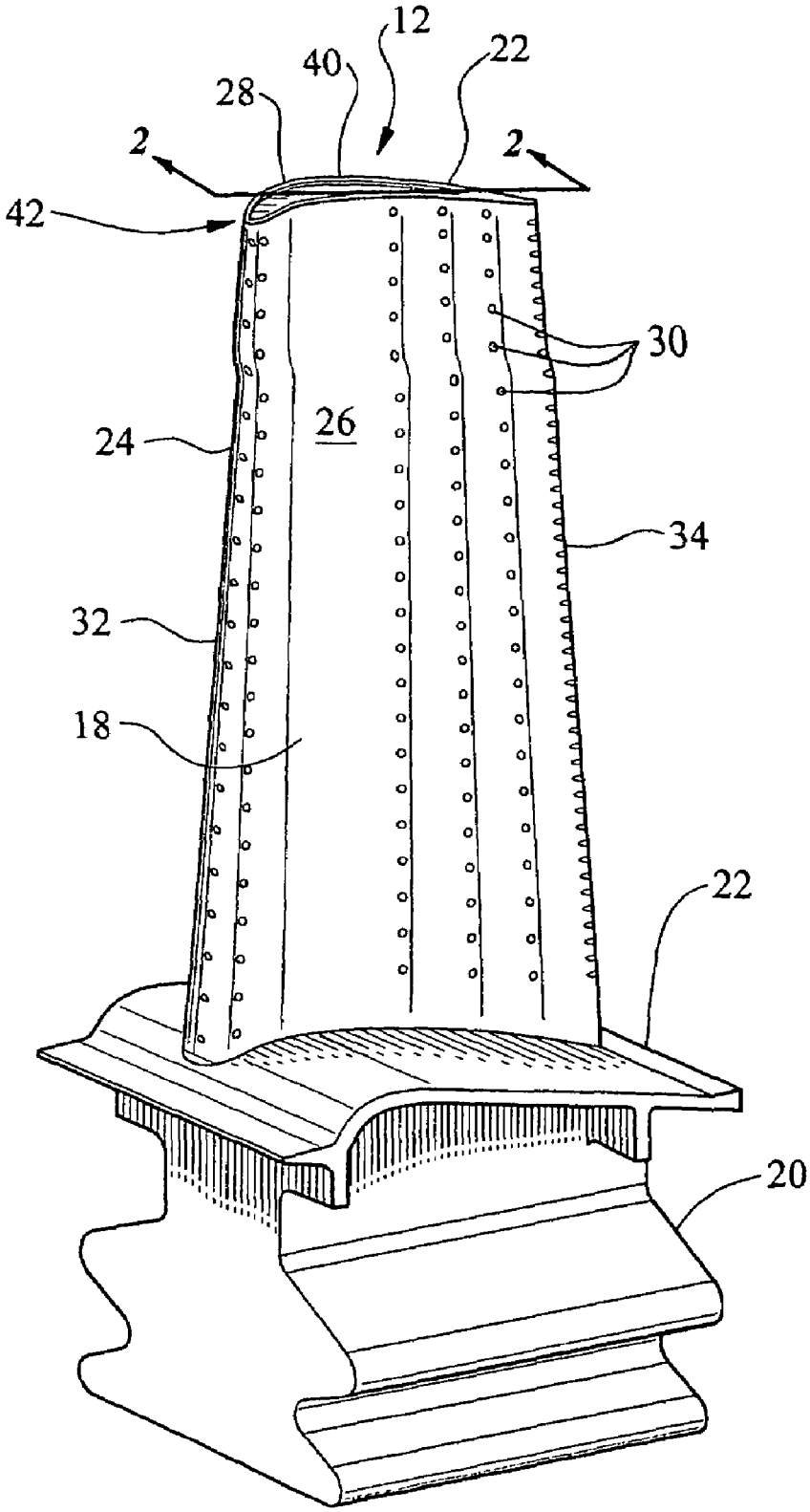
FIG. 1 is a perspective view of a turbine blade having features according to the instant invention.
Figure 2:
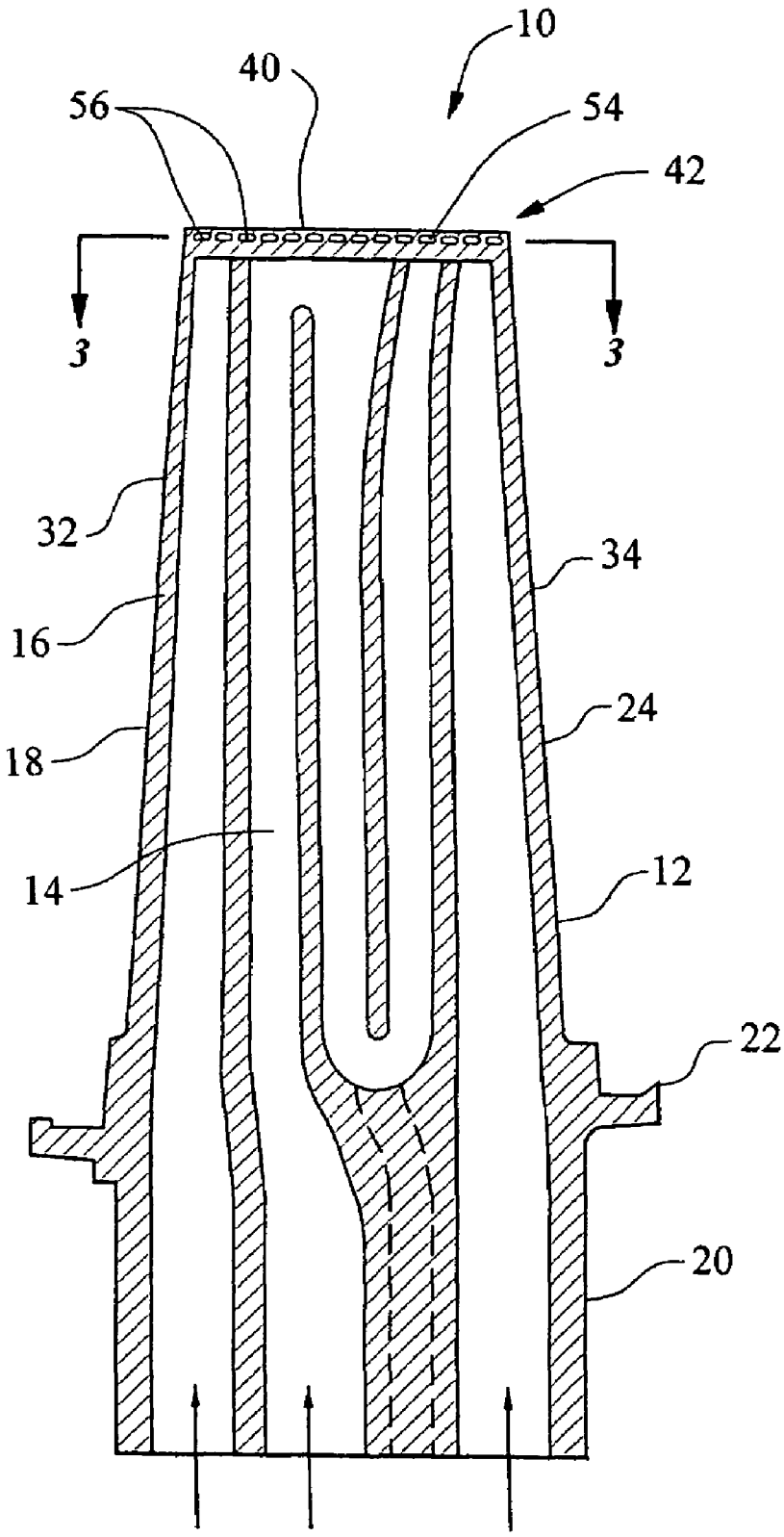
FIG. 2 is cross-sectional view, referred to as a filleted view, of the turbine blade shown in FIG. 1 taken along line 2-2.

As shown in FIGS. 1-4, this invention is directed to a turbine blade cooling system 10 for turbine blades 12 used in turbine engines. In particular, the turbine blade cooling system 10 is directed to a cooling system 10 located in a cavity 14, as shown in FIG. 2, positioned between two or more walls forming a housing 16 of the turbine blade 12. As shown in FIG. 1, the turbine blade 12 may be formed from a generally elongated blade 18 coupled to the root 20 at the platform 22. Blade 18 may have an outer wall 24 adapted for use, for example, in a first stage of an axial flow turbine engine. Outer wall 24 may form a generally concave shaped portion forming pressure side 26 and may have a generally convex shaped portion forming suction side 28.

The cavity 14, as shown in FIG. 2, may be positioned in inner aspects of the blade 18 for directing one or more gases, which may include air received from a compressor (not shown), through the blade 18 and out one or more orifices 30 in the blade 20 to reduce the temperature of the blade 20. As shown in FIG. 1, the orifices 30 may be positioned in a leading edge 32, or a trailing edge 34, or any combination thereof, and have various configurations. The cavity 14 may be arranged in various configurations and is not limited to a particular flow path.

Figure 3:
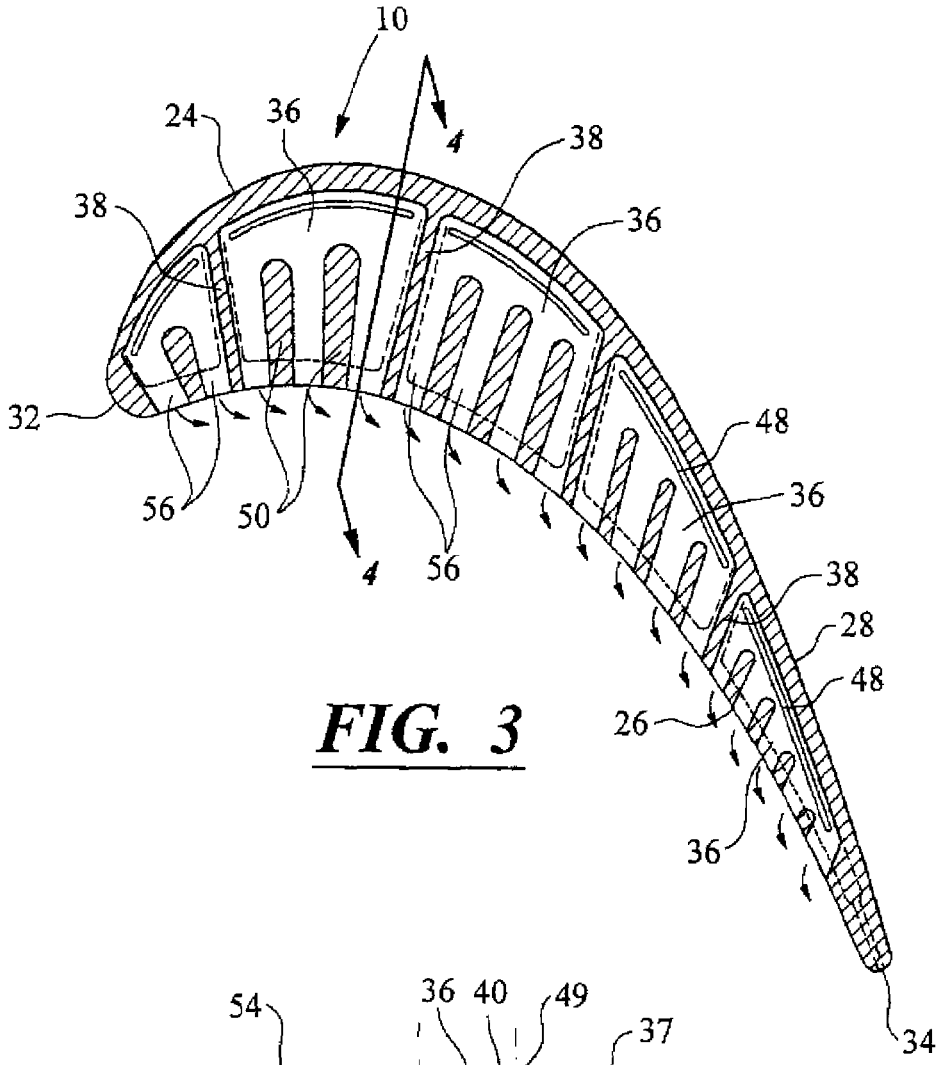
FIG. 3 is a cross-sectional view of the turbine blade shown in FIG. 2 taken along line 3-3.
Figure 4:
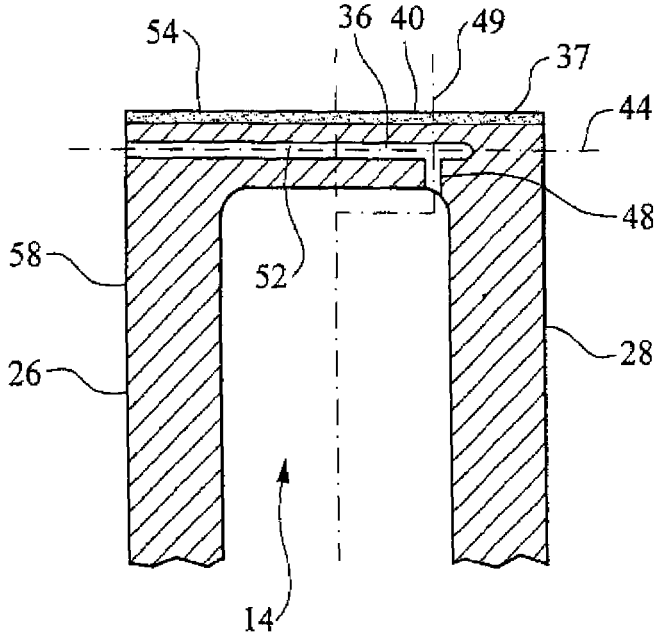
FIG. 4 is a partial cross-sectional view of the turbine blade shown in FIG. 3 taken along line 4-4.

The cooling system 10, as shown in FIGS. 2 and 3, may also include one or more elongated tip cooling chambers 36 in communication with the cavity 14. In at least one embodiment, as shown in FIG. 3, there may be a plurality of elongated tip cooling chambers extending from the leading edge 32 to the trailing edge 34, whereby each elongated tip cooling chamber 36 is separated by a rib 38 extending from the pressure sidewall 26 to the suction sidewall 28. The elongated tip cooling chambers 36 may be configured to pass cooling fluids in close proximity to an end 40 of a tip section 42 of the turbine blade 12. The end 40 of the tip section 42 may or may not have an abrasive region 37. In at least one embodiment, the elongated tip cooling chamber 36 may be configured to pass the cooling fluids generally along a longitudinal axis 44 of the elongated tip cooling chamber 36 that is generally orthogonal to a longitudinal axis 46 of the turbine blade 12. The elongated tip cooling chamber 36 may also have a relatively small radial thickness in relation to its length and width, as shown in FIGS. 3 and 4, thereby giving it an elongated configuration. The elongated tip cooling chamber 36 may extend from the pressure sidewall 26 to the parting line 49 of the turbine blade 12.

The elongated tip cooling chamber 36 may be in fluid communication with the cavity 14 through one or more cooling fluid orifices 48, as shown in FIGS. 3 and 4. In at least one embodiment, the cooling fluid orifices 48 are metering slots 48 that may be individually sized to produce efficient cooling fluid flow based upon supply fluid pressures and exit pressures. Thus, the metering slots 48 may be sized differently from the leading edge 32 to the trailing edge 34. In at least one embodiment, each elongated tip cooling chamber 36 may include a plurality of metering slots 48. In at least one embodiment, the metering slots 48 may be positioned in close proximity to the parting line 49 of the blade 12.

The elongated tip cooling chamber 36 may also include one or more ribs 50 positioned in the chamber 36 and extending from proximate the pressure sidewall 26 toward the metering slots 48. The ribs 50 may increase the surface area in the chamber 36 and increase the overall heat transfer within the chamber 36. In addition, the ribs 50 form slots 56 that are sized to exhaust cooling fluids through the pressure sidewall 26 without creating disruptive turbulence in the film layer of cooling fluids in close proximity to the outer surface 58 of the pressure sidewall 26.

During operation, cooling fluids, which may be, but are not limited to, air, flow through into the cooling system 10 from the root 20. At least a portion of the cooling fluids flow into the cavity 14. At least some of the cooling fluids flow through the metering slots 48 and into the elongated tip cooling chambers 36. The amount of cooling fluids passing through the metering slots 48 is regulated by the size of the metering slots 48. The cooling fluids collect in the elongated tip cooling chambers 36 and remove heat from the backside 52 of the outer wall 54 forming the end 40 of the tip section 42. The cooling fluids flow through the elongated tip cooling chambers 36 and through the slots 56 formed by the ribs 50. The cooling fluids are then exhausted from the cooling system 10 through the pressure sidewall 26. Once exhausted from the turbine blade 12, the cooling fluids form a film of cooling fluids against the outer surface 58 of the pressure sidewall 26 and the outer wall 54 on the end 40 of the tip section 42. The film of cooling fluids removes heat from the outer surfaces 58 of the pressure sidewall 26 and the tip section 42.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

a plurality of elongated tip cooling chambers forming a portion of the cooling system and positioned in the tip section proximate to an outer end of the tip section, wherein each of the elongated tip cooling chambers includes openings in a pressure sidewall for exhausting cooling fluids from the cooling system in the blade;

wherein the elongated tip cooling chambers each comprise a plurality of parallel, linear ribs extending from the pressure sidewall toward a suction sidewall forming parallel flow cooling channels for directing cooling fluids and enhancing the cooling capabilities of the turbine blade by acting as a heat transfer rib; and a cooling fluid orifice extending between the at least one cavity and each of the elongated tip cooling chambers, wherein each of the elongated tip cooling chambers includes the cooling fluid orifice that spans each of the parallel, linear ribs in the elongated tip cooling chamber and is in fluid communication with each of the parallel flow cooling channels in the elongated tip cooling chamber for providing a uniform cooling fluid flow through the elongated tip cooling chamber from proximate a suction sidewall to the pressure sidewall.

2. The turbine blade of claim 1, wherein each of the elongated tip cooling chambers has a low profile with a longitudinal axis of the elongated tip cooling chamber that is generally orthogonal to a longitudinal axis of the generally elongated blade.

3. The turbine blade of claim 1, wherein the elongated tip cooling chambers extend from a parting line of the elongated blade to the pressure sidewall.

4. The turbine blade of claim 1, wherein the at least one cooling fluid orifice comprises a plurality of metering slots extending between the at least one cavity and each of the elongated tip cooling chambers.

5. The turbine blade of claim 4, wherein the metering slots are independently sized relative to each other to enable the cooling flow from the turbine blade to be tailored relative to cooling fluid supply pressures.

6. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade, wherein the at least one cavity comprises a cooling fluid supply cavity positioned in the generally elongated blade for supplying cooling fluid to the turbine blade;

a plurality of elongated tip cooling chambers forming a portion of the cooling system and positioned in the tip section proximate to an outer end of the tip section, wherein each of the elongated tip cooling chambers includes openings in a pressure sidewall for exhausting cooling fluids from the cooling system in the blade;

wherein the elongated tip cooling chambers each comprise a plurality of parallel, linear ribs extending from the pressure sidewall toward a suction sidewall forming parallel flow cooling channels;

a cooling fluid orifice extending between the at least one cavity and each of the elongated tip cooling chambers, wherein each of the elongated tip cooling chambers includes a cooling fluid orifice that spans each of the parallel, linear ribs in the elongated tip cooling chamber and is in fluid communication with each of the parallel flow cooling channels in the elongated tip cooling chamber for providing a uniform cooling fluid flow through the elongated tip cooling chamber from proximate a suction sidewall to the pressure sidewall; and wherein the at least one cooling fluid orifice comprises a plurality of metering slots extending between the cooling fluid supply cavity and the elongated tip cooling chambers.

7. The turbine blade of claim 6, wherein the elongated tip cooling chambers have a low profile with longitudinal axes that are generally orthogonal to a longitudinal axis of the generally elongated blade.

8. The turbine blade of claim 6, wherein the elongated tip cooling chambers extend from a parting line of the elongated blade to the pressure sidewall.

9. The turbine blade of claim 6, wherein the metering slots are independently sized relative to each other to enable the cooling flow from the turbine blade to be tailored relative to cooling fluid supply pressures.

10. A method of cooling a tip of a turbine blade of a turbine engine, comprising:

passing cooling fluids from a root of a turbine blade through an internal cooling system, wherein the turbine blade comprises a generally elongated blade having a leading edge, a trailing edge, a tip section at a first end, a root coupled to the blade at an end generally opposite the first end for supporting the blade and for coupling the blade to a disc, at least one cavity forming the cooling system in the blade, wherein the at least one cavity comprises a cooling fluid supply cavity positioned in the generally elongated blade for supplying cooling fluid to the turbine blade elongated tip cooling chambers forming a portion of the cooling system and positioned in the tip section proximate to an outer end of the tip section, wherein each of the elongated tip cooling chambers include openings in a pressure sidewall for exhausting cooling fluids from the cooling system in the blade, wherein the elongated tip cooling chambers each comprise a plurality of parallel, linear ribs extending from the pressure sidewall toward a suction sidewall forming parallel flow cooling channels, a cooling fluid orifice extending between the cooling fluid supply cavity and each of the elongated tip cooling chambers, and wherein each of the elongated tip cooling chambers includes the cooling fluid orifice that spans each of the parallel, linear ribs in the elongated tip cooling chamber and is in fluid communication with each of the parallel flow cooling channels in the elongated tip cooling chamber for providing a uniform cooling fluid flow through the elongated tip cooling chamber from proximate a suction sidewall to the pressure sidewall;

wherein passing cooling fluids through the internal cooling system comprises passing cooling fluids through the at least one opening between the cavity and the elongated tip cooling chambers, passing cooling fluids through the elongated tip cooling chambers between the ribs forming parallel flow cooling channels, and exhausting cooling fluids from the turbine blade through openings in the pressure sidewall.

* * * * *